US005925976A

United States Patent [19]

Hayashida et al.

[11] Patent Number: 5,925,976

[45] Date of Patent: Jul. 20, 1999

[54] CATHODE FOR ELECTRON TUBE HAVING SPECIFIC EMISSIVE MATERIAL

[75] Inventors: Yoshiki Hayashida; Tetsuro Ozawa; Hiroshi Sakurai; Masaki Kawasaki, all of Osaka, Japan

[73] Assignee: Matsushita Electronics Corporation, Osaka, Japan

[21] Appl. No.: 08/966,113

[22] Filed: Nov. 7, 1997

[30] Foreign Application Priority Data

Nov. 12, 1996 [JP] Japan ..... 8-300024
Nov. 12, 1996 [JP] Japan ..... 8-300025

[51] Int. Cl.[6] ..... H01J 1/14

[52] U.S. Cl. ..... 313/346 R; 313/446; 313/346 DC; 313/337

[58] Field of Search ..... 313/446, 270, 313/337, 346 R, 346 DC

[56] References Cited

U.S. PATENT DOCUMENTS

| | | | |
|---|---|---|---|
| 1,870,951 | 8/1932 | Fredenburgh . | |
| 2,703,790 | 3/1955 | Anderson . | |
| 4,797,593 | 1/1989 | Saito et al. . | |
| 4,924,137 | 5/1990 | Watanabe et al. | 313/337 |
| 5,059,856 | 10/1991 | Derks . | |
| 5,347,194 | 9/1994 | Derks . | |

FOREIGN PATENT DOCUMENTS

| | | |
|---|---|---|
| 0 330 355 | 8/1989 | European Pat. Off. . |
| 0 373 701 | 6/1990 | European Pat. Off. . |
| 0 482 704 | 4/1992 | European Pat. Off. . |
| 869 892 | 2/1942 | France . |
| 1 029 729 | 6/1953 | France . |
| 62-22347 | 1/1987 | Japan . |
| 63-257153 | 10/1988 | Japan . |
| 1-315926 | 12/1989 | Japan . |
| 182 817 | 8/1923 | United Kingdom . |
| 663981 | 1/1952 | United Kingdom . |
| 700313 | 11/1953 | United Kingdom . |

OTHER PUBLICATIONS

Bol'Shakov, et al., "Phase imhomogeneity of mixed crystals of alkaline earth carbonates and its influence on the properties of oxide cathodes", Inorganic Materials, vol. 13, No. 5, May 1997, pp. 1025–1028.

*Primary Examiner*—Vip Patel
*Attorney, Agent, or Firm*—Merchant, Gould, Smith, Edell, Welter & Schmidt, P.A.

[57] ABSTRACT

A cathode for an electron tube is described that has little deterioration of emission current after long operation, is used as a long-life oxide cathode even with high current density in a CRT, and is economical. An emissive material is adhered onto a substrate that is positioned at one opening of a cylindrical sleeve having a built-in heater coil and that includes nickel as a main component by thermally decomposing carbonate including an alkaline earth metal oxide and at least one element selected from the group consisting of titanium, nickel, zirconium, vanadium, niobium and tantalum.

19 Claims, 14 Drawing Sheets

CATHODE FOR ELECTRON TUBE HAVING SPECIFIC EMISSIVE MATERIAL

BACKGROUND OF THE INVENTION

The present invention relates to a cathode for electron tubes such as cathode-ray tubes (CRT) used for television or information displays.

As shown in FIG. 14, a conventional cathode for an electron tube includes a heater coil 101, a cylindrical sleeve 102 with the built-in heater coil 101, a metal substrate 103, containing nickel as a main component and a trace of reducing elements such as magnesium, at one opening of the sleeve 102, and an emissive material layer 104 adhered onto the substrate 103. For the emissive material layer 104, a material that includes as a main component an alkaline earth metal oxide containing barium is used as an oxide cathode. A phenomenon is found that the emission current of such a cathode gradually decreases after long operation of several thousand hours due to the deterioration of emissive materials.

Therefore, a proposal has been tested to improve the life of a cathode by adding from 0.3 wt. % to 15 wt. % of rare earth metals such as scandium oxide and yttrium oxide to an emissive material layer (Japanese Laid-open Patent Publication No. 62-22347).

Another proposal also has been tested whereby zirconium oxide or hafnium oxide is added to an emissive material layer at from 0.1 wt. % to 10 wt. % so as to extend the life of a cathode (Japanese Laid-open Patent Publication No. 2-195628).

Due to the recent increase in current density accompanied by the improvement of CRT display properties, there is a problem in that more and more load is added to a cathode, shortening the life of the cathode. Thus, a cathode has been demanded that has a longer life than conventional cathodes.

SUMMARY OF THE INVENTION

It is, therefore, an object of the present invention to provide a long-life cathode—particularly, a cathode for an electron tube that has little decrease in emission current after long operation and has a sufficient life even if the current density is further increased in a CRT, and to provide a long-life and economical cathode for an electron tube.

The present invention provides a cathode for an electron tube in which an emissive material, having particles that include the oxide of an alkaline earth metal as a main component and at least one element selected from the group consisting of titanium, zirconium and hafnium, is adhered onto a metal substrate including nickel as a main component.

The present invention also provides a cathode for an electron tube in which an emissive material, including the oxide of an alkaline earth metal as a main component and at least one element selected from the group consisting of vanadium, niobium and tantalum, is adhered onto a metal substrate including nickel as a main component.

In the present invention, a long-life cathode for an electron tube is provided. Particularly, by adding, along with the oxide of an alkaline earth metal, at least one element selected from the group consisting of titanium, zirconium and hafnium to the emissive material of a cathode, the properties of the emissive material improve, especially in reducing the deterioration of the emission current under high current density. Also, an economical and long-life cathode with long emission current stability is provided by adding, along with the oxide of an alkaline earth metal, at least one element selected from the group consisting of vanadium, niobium and tantalum to the emissive material of the cathode.

The present invention provides a method for manufacturing a cathode for an electron tube, including the step of thermally decomposing carbonate containing at least one element selected from the group consisting of titanium, zirconium, hafnium, vanadium, niobium and tantalum and an alkaline earth metal so as to adhere an emissive material, containing the oxide of the alkaline earth metal as a main component and the above-noted element, onto a metal substrate including nickel as a main component. In this method, the element such as titanium is evenly provided in each particle of the alkaline earth metal oxide, so that a cathode with even emissive properties and stability is provided.

A first cathode of the present invention has an emissive material, including particles containing the oxide of an alkaline earth metal as a main component and at least one element selected from the group consisting of titanium, zirconium and hafnium, adhered onto a metal substrate including nickel as a main component.

It is preferable in the first cathode that the total content of at least one element selected from the group consisting of titanium, zirconium and hafnium is from 0.001 wt. % to 1 wt. %, or more preferably from 0.001 wt. % to 0.1 wt. %, relative to the total weight of the emissive material. Therefore, the emissive properties of the cathode improve. The cathode can be used under high current density.

It is also preferable in the first cathode that the emissive material further includes particles of an alkaline earth metal oxide. Thus, as described above, the cathode has improved emissive properties, and can be used under high current density. More specifically, it is preferable that the emissive material includes the mixture of the particles containing the oxide of an alkaline earth metal as a main component and at least one element selected from the group consisting of titanium, zirconium and hafnium and the particles of an alkaline earth metal oxide. In this case, it is preferable that the particles containing the oxide of an alkaline earth metal as a main component and at least one element selected from the group consisting of titanium, zirconium and hafnium are included at 20 wt. % to 80 wt. % relative to the total weight of the emissive material. As a result, the emissive properties of the cathode further improve.

A second cathode of the present invention has an emissive material including particles, containing the oxide of an alkaline earth metal as a main component and at least one element selected from the group consisting of vanadium, niobium and tantalum, adhered onto a metal substrate including nickel as a main component.

It is preferable in the second cathode that the content of the above-mentioned element is from 0.001 wt. % to 5 wt. % relative to the total weight of the emissive material when the element is included as a metal. Thus, the emission current is stabilized for a long period, and the life of the cathode increases.

It is also preferable in the second cathode that the content of the element is from 0.002 wt. % to 6 wt. % relative to the total weight of the emissive material when the element is included as an oxide. Therefore, as mentioned above, the emission current would be stabilized for a long period, and an economical and long-life cathode is provided. In this case, it is further preferable that the oxide is in the form of particles having an average particle diameter of 10 $\mu$m or less, so that the emission current further stabilizes for a long period.

A first method of the present invention includes the step of thermally decomposing carbonate, containing at least one element selected from the group consisting of titanium, zirconium and hafnium and an alkaline earth metal, so as to adhere the particles of an emissive material, containing the oxide of the alkaline earth metal as a main component and the element mentioned above, onto a metal substrate including nickel as a main component. In this method, the element such as titanium is evenly provided in each particle of the alkaline earth metal oxide, so that a cathode with even emissive properties and stability is provided.

It is preferable in the first method that the method further includes the step of coprecipitating, from a solution including the nitrate of at least one element selected from the group consisting of titanium and zirconium and the nitrate of an alkaline earth metal, the above-mentioned element and alkaline earth metal as carbonate. By this method, the residual impurities in the emissive material are significantly reduced, so that a decrease in emissive properties from impurities would be prevented.

In this case, it is further preferable that the above-mentioned element and alkaline earth metal are coprecipitated as carbonate by mixing the solution containing the nitrate mentioned above with a solution including a carbonate ion (more preferably, a solution containing at least one salt selected from the group consisting of the carbonate of an alkaline metal, the hydrogencarbonate of an alkaline metal, ammonium carbonate and ammonium hydrogencarbonate).

A second method of the present invention includes the step of thermally decomposing carbonate, containing at least one element selected from the group consisting of vanadium, niobium and tantalum and an alkaline earth metal, so as to adhere an emissive material containing the oxide of the alkaline earth metal as a main component and the element mentioned above onto a metal substrate including nickel as a main component. In this method, the element such as vanadium is evenly provided in each particle of the alkaline earth metal oxide, so that a cathode with even emissive properties and stability is provided.

It is preferable in the second method that the method further includes the step of coprecipitating, from a solution including the nitrate of at least one element selected from the group consisting of vanadium and niobium and the nitrate of an alkaline earth element, the above-noted element and alkaline earth element as carbonate. By this method, the residual impurities in the emissive material are significantly reduced, so that a decrease in emissive properties from impurities would be prevented.

In this case, it is more preferable that the above-mentioned element and alkaline earth element are coprecipitated as carbonate by mixing the solution containing the nitrate mentioned above with a solution containing a carbonate ion (more preferably, a solution containing at least one salt selected from the group consisting of the carbonate of an alkaline metal, the hydrogencarbonate of an alkaline metal, ammonium carbonate and ammonium hydrogencarbonate).

In this second method, it is preferable that the method further includes the step of coprecipitating tantalum and an alkaline earth metal as carbonate by mixing a solution containing the carbonate of the alkaline earth metal and tantalum with a solution containing the nitrate of the alkaline earth metal. As described above, the residual impurities in the emissive material would be reduced in this method, so that the life of the cathode increases.

DETAILED DESCRIPTION OF THE PREFERRED EMBODIMENTS

The preferred embodiments of the present invention are now explained using the figures.

Figure 1:
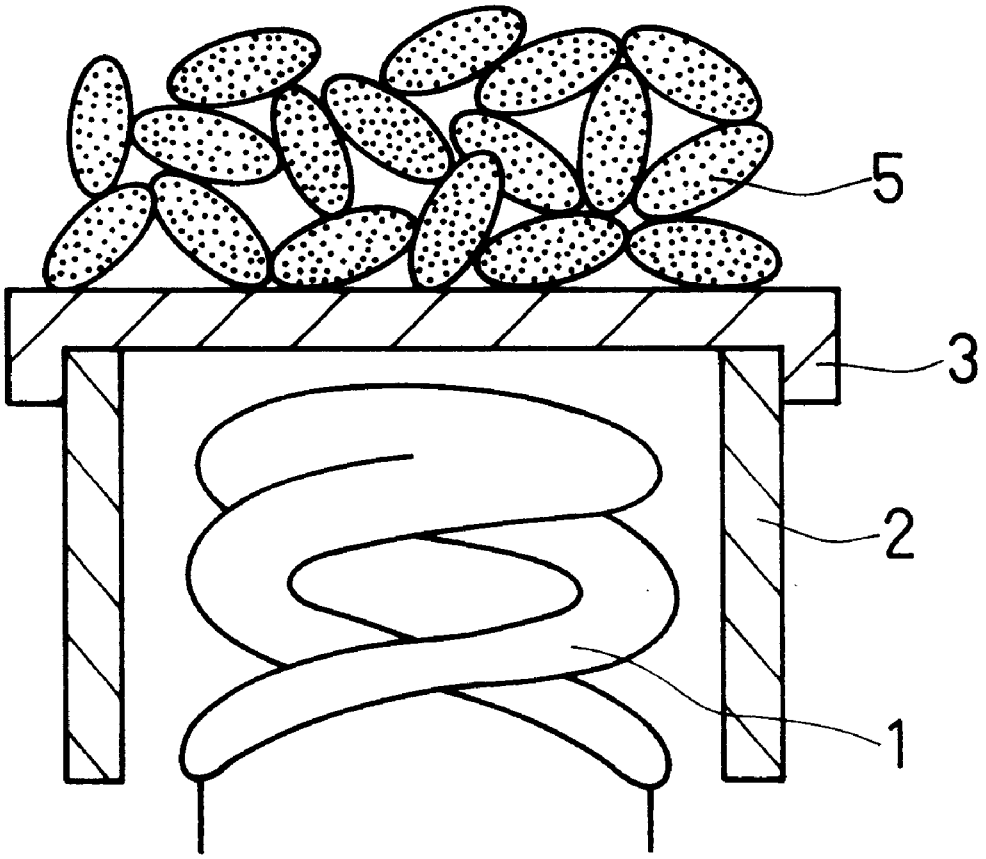
FIG. 1 is a cross-sectional view showing an embodiment of a schematic structure of a cathode of the present invention.

FIG. 1 shows a schematic structure of one embodiment of a cathode of the present invention. The cathode includes a heater coil 1, a cylindrical sleeve 2 with the built-in heater coil 1, a metal substrate 3 that contains nickel as a main component and a trace of reducing elements such as magnesium positioned at one opening of the sleeve 2, and an emissive material layer, including particles 5 containing barium and an alkaline earth metal oxide as a main component, adhered onto the substrate 3. Each particle includes at least one element selected from the group consisting of titanium, zirconium and hafnium.

Figure 2:
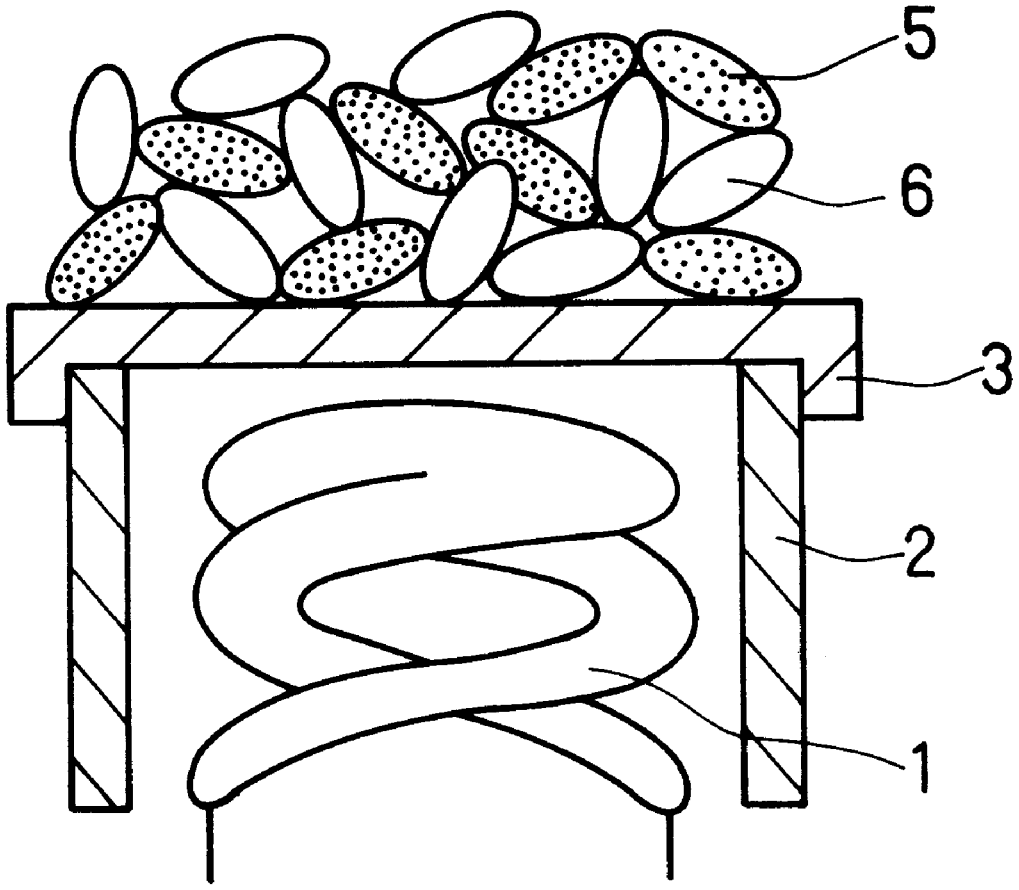
FIG. 2 is a cross-sectional view showing another embodiment of a schematic structure of a cathode of the present invention.

FIG. 2 shows a schematic structure of another embodiment of a cathode of the present invention. In this case, an emissive material layer includes particles 5, containing an alkaline earth metal oxide as a main component and titanium and the like, and particles 6 of alkaline earth metal oxides.

Figure 14:
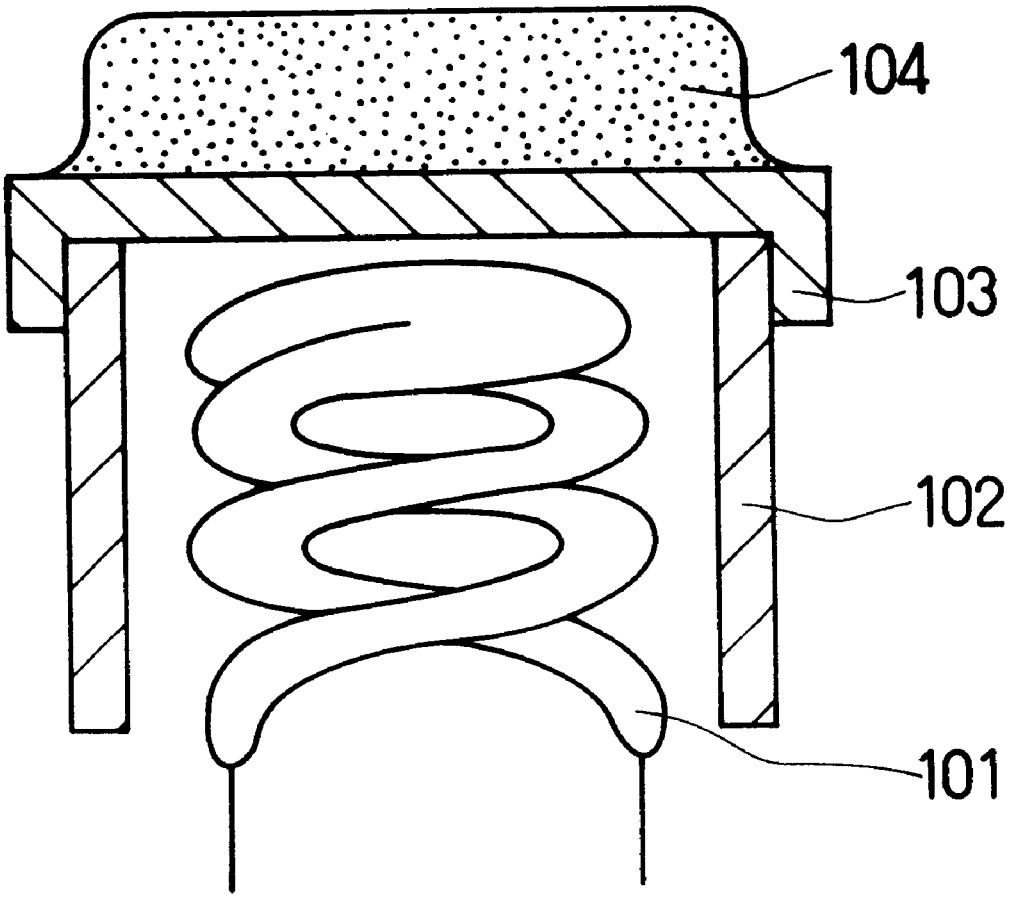
FIG. 14 is a cross-sectional view showing an embodiment of a schematic structure of a conventional cathode.

Therefore, the emissive material layers shown in FIG. 1 and FIG. 2 that are adhered onto a substrate as the particles 5 and 6 are different from the conventional emissive material layer 4 shown in FIG. 14.

Figure 3:
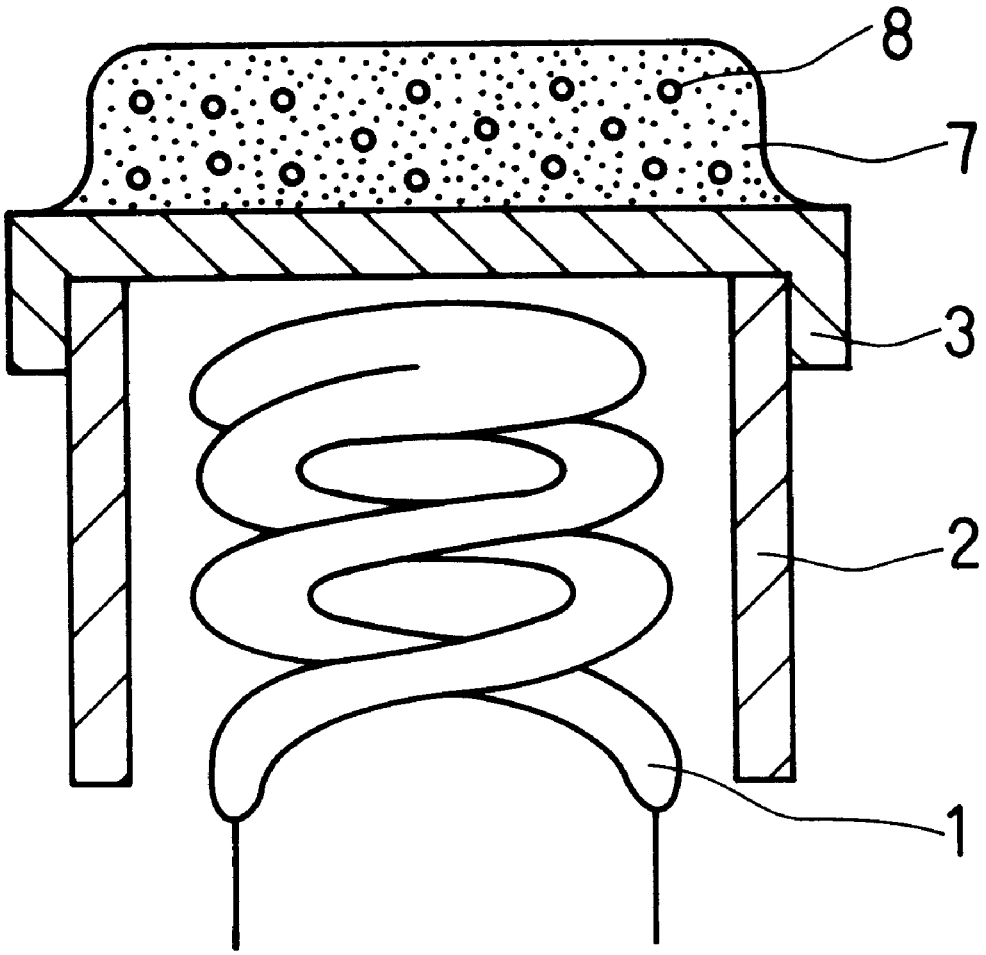
FIG. 3 is a cross-sectional view showing another embodiment of a schematic structure of a cathode of the present invention.

FIG. 3 shows a schematic structure of another embodiment of a cathode of the present invention. As in FIG. 1, the cathode shown in FIG. 3 includes a heater coil 1, a cylindrical sleeve 2 with the built-in heater coil 1, a metal substrate 3 that contains nickel as a main component and a trace of reducing elements such as magnesium positioned at one opening of the sleeve 2, and an emissive material layer including an alkaline earth metal oxide 7 containing barium and at least one metal selected from the group consisting of vanadium, niobium and tantalum (or an oxide thereof) 8, adhered onto the substrate 3.

EXAMPLES

The present invention is explained in further detail by referring to the following examples, which are not intended to limit this invention.

Example 1

Zirconium nitrate was dissolved in a solution of alkaline earth metal nitrate, including barium nitrate and strontium nitrate, so as to have a content of zirconium atoms of 0.02 mole % (mole ratio relative to the entire amount of alkaline earth metal), thus preparing a mixed solution. A solution of sodium carbonate was added to this mixed solution, thereby preparing ternary (barium/strontium/zirconium) coprecipitated carbonate particles in which each particle includes zirconium atoms at an average of 0.02 mole %. Instead of zirconium nitrate, zirconium (IV) dinitrate oxide may be used. Similarly, the carbonate or the hydrogencarbonate of an alkaline metal, ammonium carbonate, or ammonium hydrogencarbonate may be used instead of sodium carbonate.

The ternary coprecipitated carbonate particles were adhered onto a cathode substrate in a thickness of about 50 $\mu$m, and were thermally decomposed in a vacuum at 930° C. As a result, a cathode having the same structure as in FIG. 1 was provided that had an emissive material layer including ternary (barium/strontium/zirconium) oxide particles (with 0.015 wt. % average content of zirconium).

In the above-mentioned method for manufacturing the cathode, titanium nitrate or hafnium chloride was used instead of zirconium nitrate so as to provide a cathode having the same structure as in FIG. 1 and having an emissive material layer including barium/strontium/titanium or barium/strontium/hafnium oxide particles with 0.015 wt. % average content of titanium atoms or hafnium atoms.

The cathode prepared as described above was used in a CRT for displays, and an accelerated life test was carried out for 2,000 hours while the current density of the CRT was set at 2.0A/cm$^2$ at the beginning of the operation.

Figure 4:
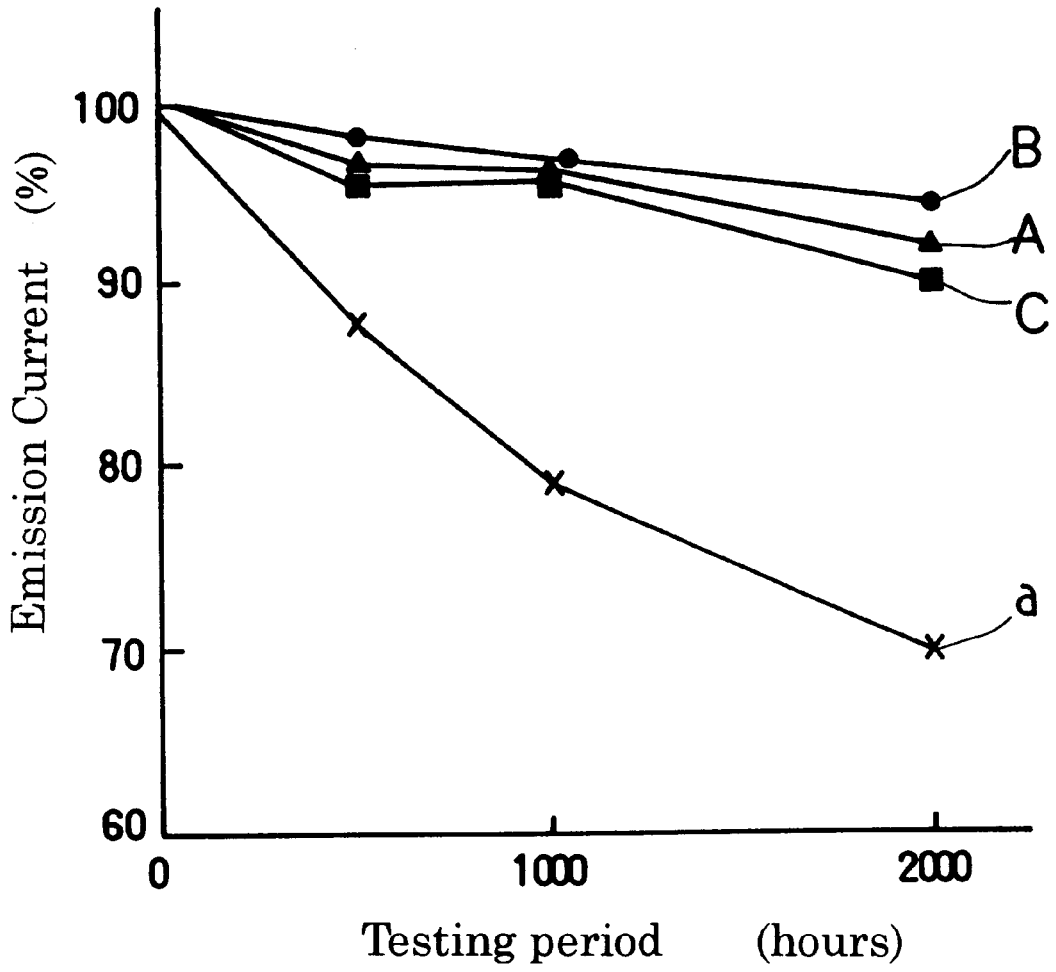
FIG. 4 is a graph showing the change in emission current with time in an embodiment of a cathode of the present invention.

FIG. 4 shows the change in emission current with time in the accelerated life test. Line A in the figure shows the result in the case of the cathode having an emissive material layer including barium/strontium/titanium coprecipitated oxide particles; line B indicates the result in the case of the cathode having an emissive material layer including barium/strontium/zirconium coprecipitated oxide particles; line C shows the result in the case of the cathode having an emissive material layer including barium/strontium/hafnium coprecipitated oxide particles; and line (a) indicates the result in the case of a conventional cathode having an emissive material layer containing the particles of an alkaline earth metal oxide.

As clearly shown in FIG. 4, the decrease in emission current of the cathode by the accelerated life test is smaller than that of the conventional cathode when titanium, zirconium or hafnium is included in each particle of the alkaline earth metal oxide, thus improving the life of the cathode. Particularly, when the particles of an alkaline earth metal oxide in which titanium or zirconium is coprecipitated are used for an emissive material layer, the decrease in emission current would be reduced significantly. This is because nitrate is used as a material in preparing carbonate particles, so that much less residual impurities are found in the emissive material layer than in the case of using the chlorides as a starting material. (The impurities are chlorine when using chloride as a starting material.)

Also, conventional cathodes require several minutes to stabilize the emission current after electric discharge begins. During this period, a phenomenon (called emission slump) of gradually decreasing emission current is found. The emission slump of the cathode prepared by coprecipitating zirconium or hafnium is about half as much as that of conventional cathodes, thus providing a highly stable electron emission. Therefore, in order to improve the life of a cathode and also reduce the emission slump, it is preferable that zirconium is coprecipitated in preparing carbonate particles.

Figure 5:
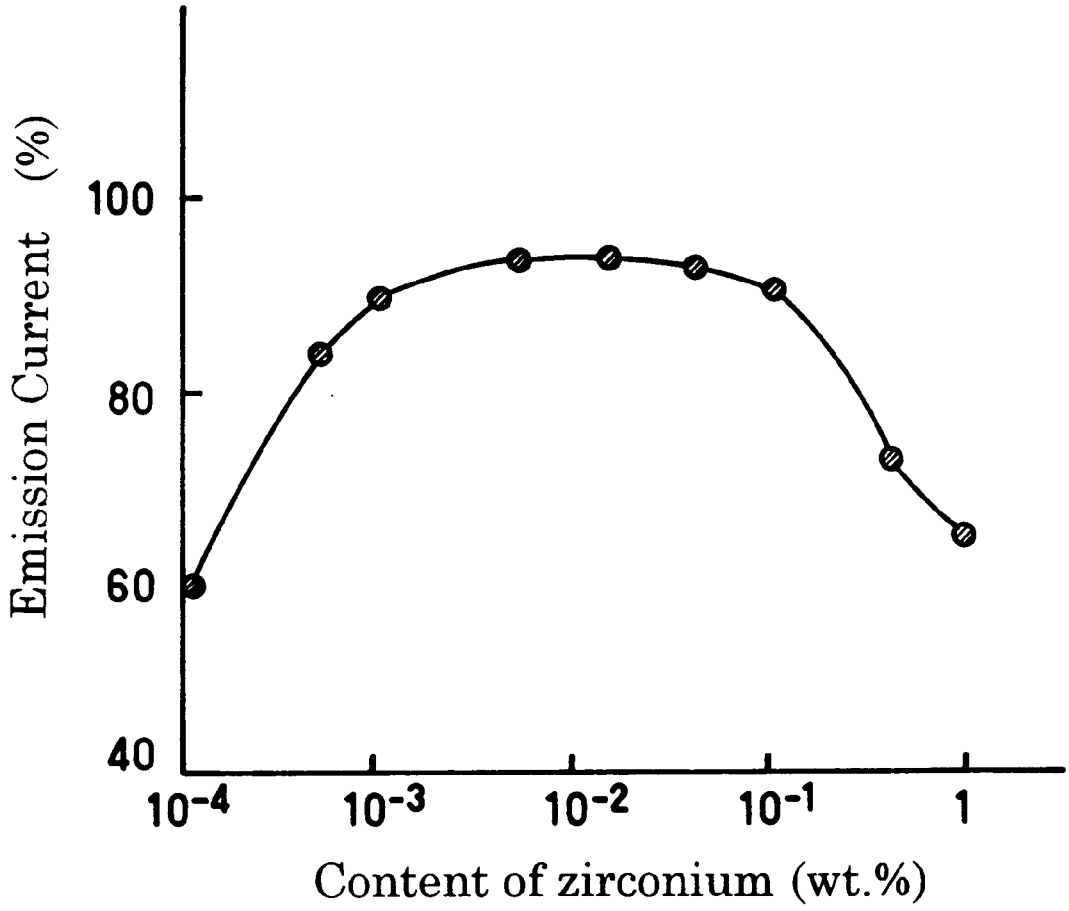
FIG. 5 is a graph showing the relationship between the content of zirconium and the change in emission current in an embodiment of a cathode of the present invention.

As shown in FIG. 5, the effect of increasing the life of a cathode is found when the content of titanium, zirconium or hafnium is from 0.001 wt. % to 1 wt. %, more preferably from 0.001 wt. % to 0.1 wt. %, relative to the total weight of the emissive material layer.

Although binary (barium/strontium) alkaline earth metals were used for oxide particles in this example, the same effects were also found in using ternary (barium/strontium/calcium) alkaline earth metals. This is also true in the following examples.

Example 2

Zirconium nitrate was dissolved in a solution of alkaline earth metal nitrate, including barium nitrate and strontium nitrate, at 0.04 mole % relative to the entire alkaline earth metal (at 0.03 wt. % relative to the particles of the alkaline earth metal oxide), thus preparing a mixed solution. A solution of sodium carbonate was added to this mixed solution, thereby precipitating ternary (barium/strontium/zirconium) carbonate particles in which zirconium atoms are contained at an average of 0.04 mole %. On the other hand, a solution of sodium carbonate was added to a mixed solution of barium nitrate and strontium nitrate for precipitation, thus providing particles of binary (barium/strontium) carbonate.

The ternary carbonate particles and the binary carbonate particles were mixed at a 1:1 weight ratio so as to prepare a mixed material of carbonate particles containing zirconium and carbonate particles containing no zirconium. The mixed material was adhered onto a cathode substrate in a thickness of about 50 $\mu$m, and was thermally decomposed in a vacuum at 930° C. Thus, a cathode was provided that had an emissive material layer including the mixed material of ternary (barium/strontium/zirconium) oxide particles 5 and binary (barium/strontium) oxide particles 6 as shown in FIG. 2.

The cathode prepared as described above was used in a CRT for displays, and an accelerated life test was carried out for 2,000 hours while the current density of the CRT was set at 2.7A/cm$^2$ at the beginning of the operation.

Figure 6:
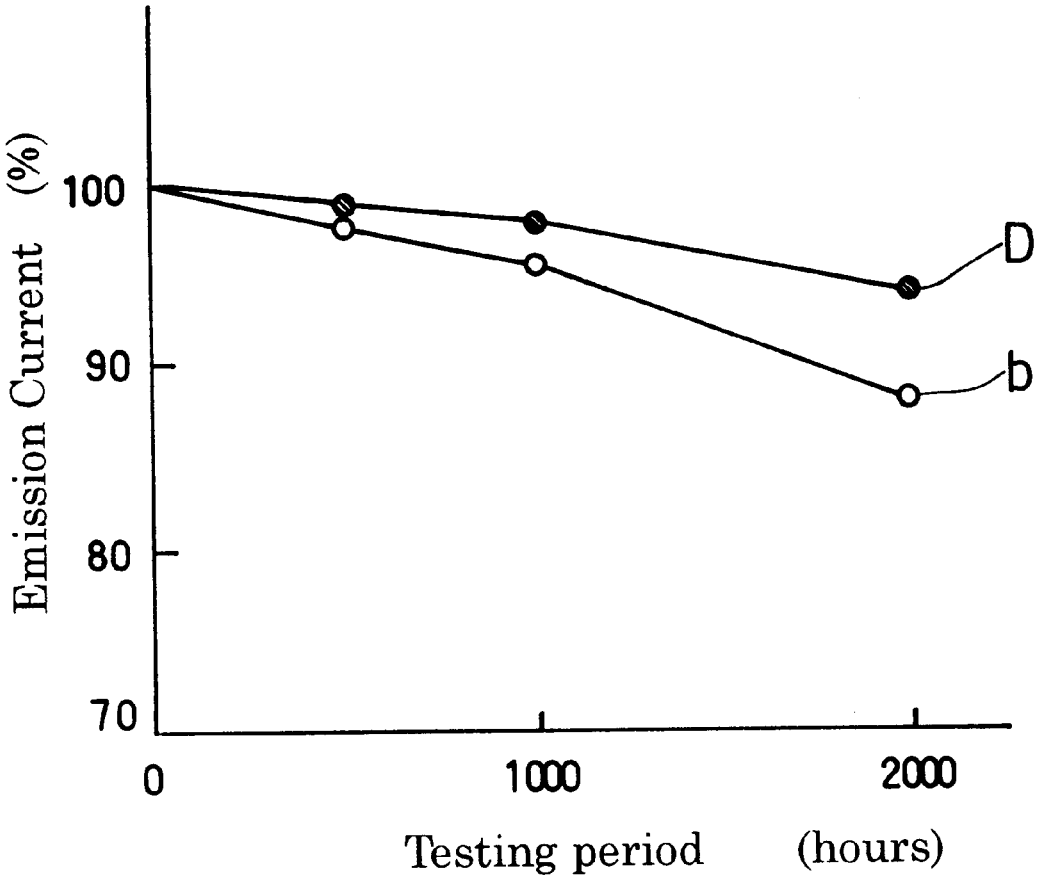
FIG. 6 is a graph showing the change in emission current with time in an embodiment of a cathode of the present invention.

FIG. 6 shows the change in emission current with time in the accelerated life test. In the figure, line D shows the result in the case of the cathode that has an emissive material layer including the mixed material of the ternary (barium/strontium/zirconium) oxide particles and the binary (barium/strontium) oxide particles; and line (b) shows the result in the case of the cathode that has an emissive material layer including only the mixed material of the ternary (barium/strontium/zirconium) oxide particles. As clearly shown in FIG. 6, the decrease in emission current of the cathode by the accelerated life test is reduced when an emissive material layer includes the mixed material of the oxide particles containing zirconium and those containing no zirconium, thus increasing the life of the tube. The same results were also obtained when titanium or hafnium was used instead of zirconium.

The effect of improving the life of a cathode was found when the particles of the alkaline earth metal oxide containing titanium, zirconium or hafnium were contained at 20 wt. % to 80 wt. % relative to the total weight of an emissive material layer.

Example 3

To binary carbonate containing barium and strontium at a 1:1 mole ratio, 0.8 wt. % (relative to the binary carbonate) of vanadium (1.1 wt. % relative to an emissive material layer) or 1.0 wt. % (relative to the binary carbonate) of vanadium oxide (1.3 wt. % relative to the emissive material layer) was added, thus preparing a mixed material of barium/strontium carbonate and vanadium or vanadium oxide. The mixed material was adhered onto a cathode substrate in a thickness of about 50 $\mu$m, and was thermally decomposed in a vacuum at 930° C. Thus, a cathode having the same structure as in FIG. 3 was provided that had an emissive material layer containing barium/strontium oxide and vanadium or vanadium oxide The cathode prepared as described above was used in a CRT for displays, and an accelerated life test was carried out for 2,000 hours while the current density of the CRT was set at 2.0A/cm$^2$ at the beginning of the operation.

Figure 7:
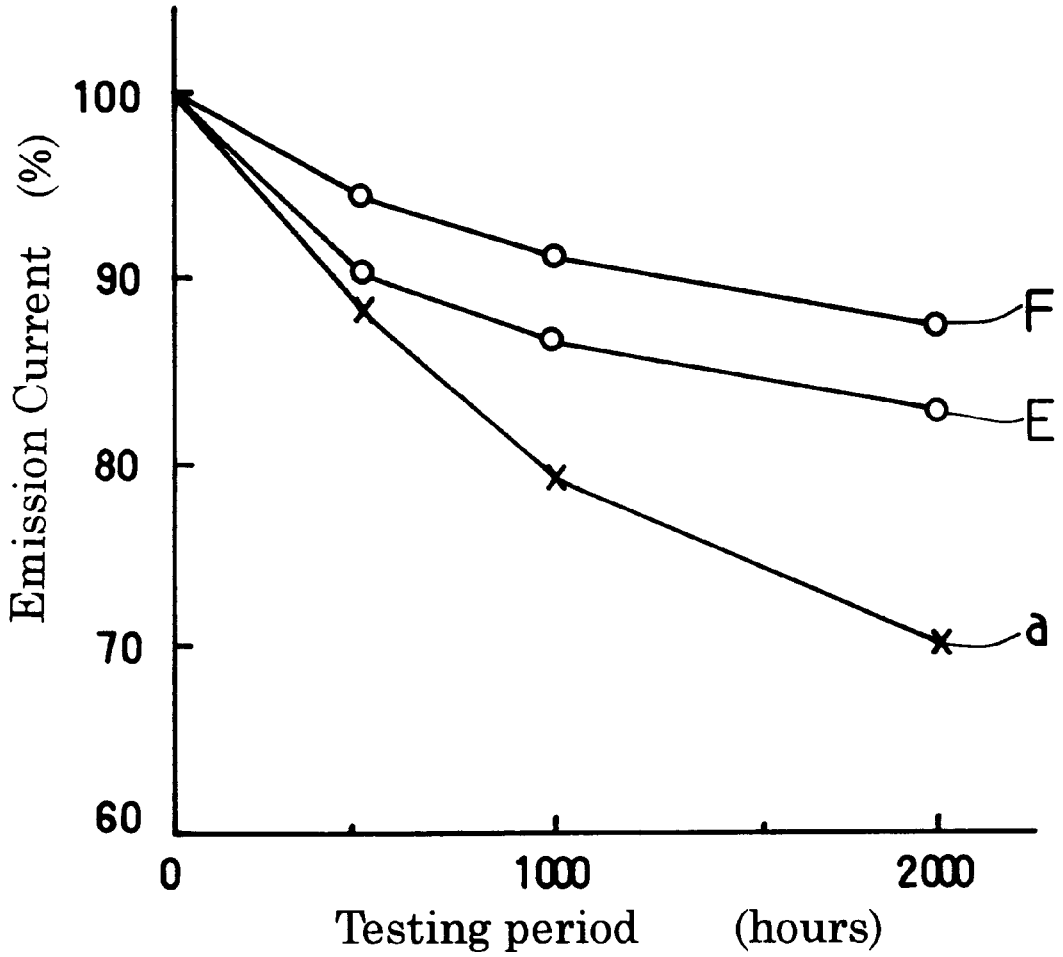
FIG. 7 is a graph showing the change in emission current with time in an embodiment of a cathode of the present invention.

FIG. 7 shows the change in emission current with time in the accelerated life test. In the figure, line E shows the result in the case of the cathode in which vanadium was added to the emissive material layer; line F indicates the result in the case of the cathode in which vanadium oxide was added to the emissive material layer; and line (a) shows the result in the case of a conventional cathode in which an emissive material layer is made only of an alkaline earth metal oxide. Compared with the conventional cathode, the deterioration of emission current of the cathode by the accelerated life test is significantly reduced as clearly shown in FIG. 7 when vanadium or vanadium oxide is added to the emissive material layer, thereby increasing the life of the tube. Especially with the use of vanadium oxide, the effects are significant, with little decrease in emission current.

Also, vanadium and vanadium oxide can be obtained easily in the industry, and are economical. Thus, by adding vanadium or vanadium oxide to an emissive material layer, an economical and long-life cathode is provided.

Figure 8:
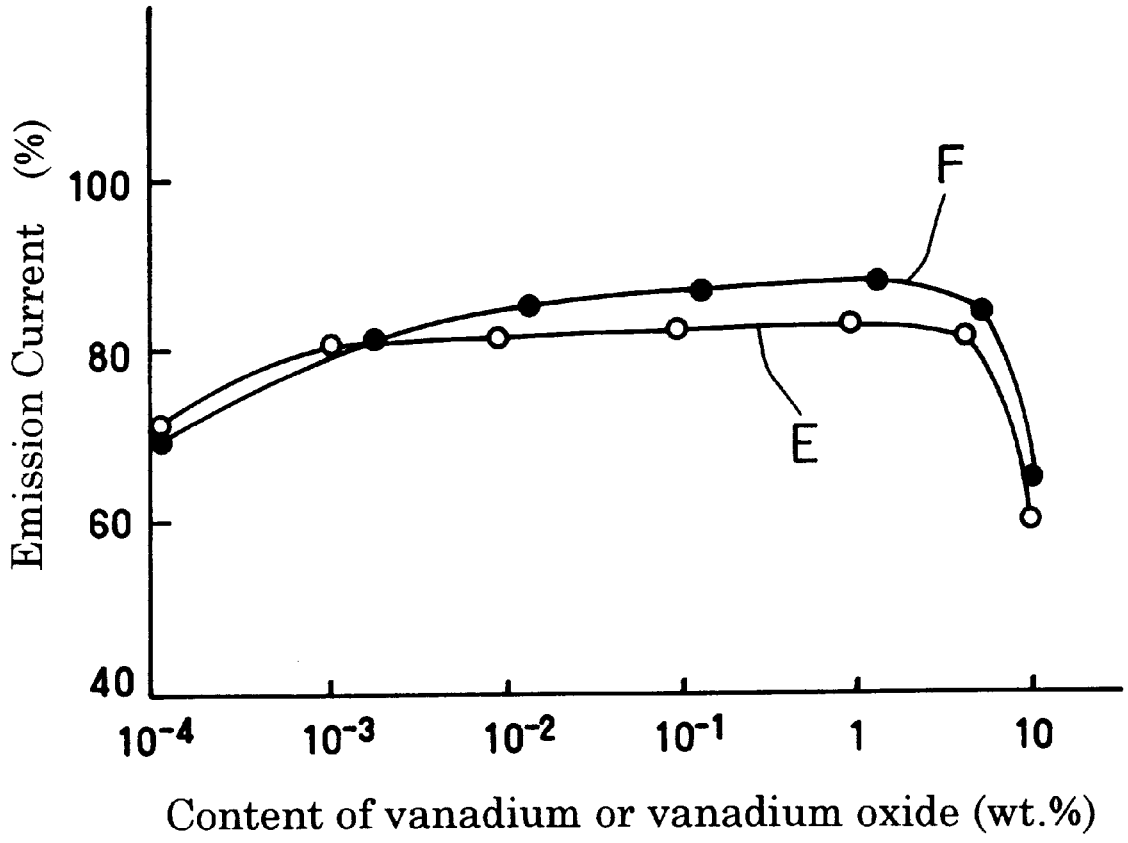
FIG. 8 is a graph showing the relationship between the content of vanadium or vanadium oxide and the change in emission current in an embodiment of a cathode of the present invention.

As shown in FIG. 8, the effects of reducing the deterioration of emission current were obtained effectively when the contents of vanadium and vanadium oxide were 0.001 wt. % to 5 wt. % and 0.002 wt. % to 6 wt. % respectively, relative to the entire weight of the emissive material layer. As shown in this example, the best effects were obtained particularly when the contents of vanadium and vanadium oxide were about 1.1 wt. % and about 1.3 wt. % respectively relative to the total weight of the emissive material layer.

Example 4

In the processes for manufacturing the cathode of Example 3, a mixed material was prepared by adding niobium oxide, instead of vanadium oxide, at 1 wt. % relative to barium/strontium carbonate (1.3 wt. % relative to an emissive material layer). The mixed material was adhered onto a cathode substrate in a thickness of about 50 $\mu$m, and was then thermally decomposed at 930° C. in a vacuum. As a result, a cathode was provided that had an emissive material layer including barium/strontium oxide and niobium oxide.

The cathode prepared as described above was used in a CRT for displays, and an accelerated life test was carried out for 2,000 hours while current density was set at 2.0A/cm$^2$ at the beginning of the operation. Regarding the deterioration of the emission current, the same results as in the case of adding vanadium oxide were obtained, thus increasing the life of the cathode.

The cathode of this example also has the properties of limiting the heat contraction of the emissive material layer. As a result, the change in cut-off voltage was reduced. The above-noted cut-off voltage indicates the cathode voltage for cutting off emission current, and the value of the voltage changes due to the heat contraction of an emissive material layer.

Figure 9:
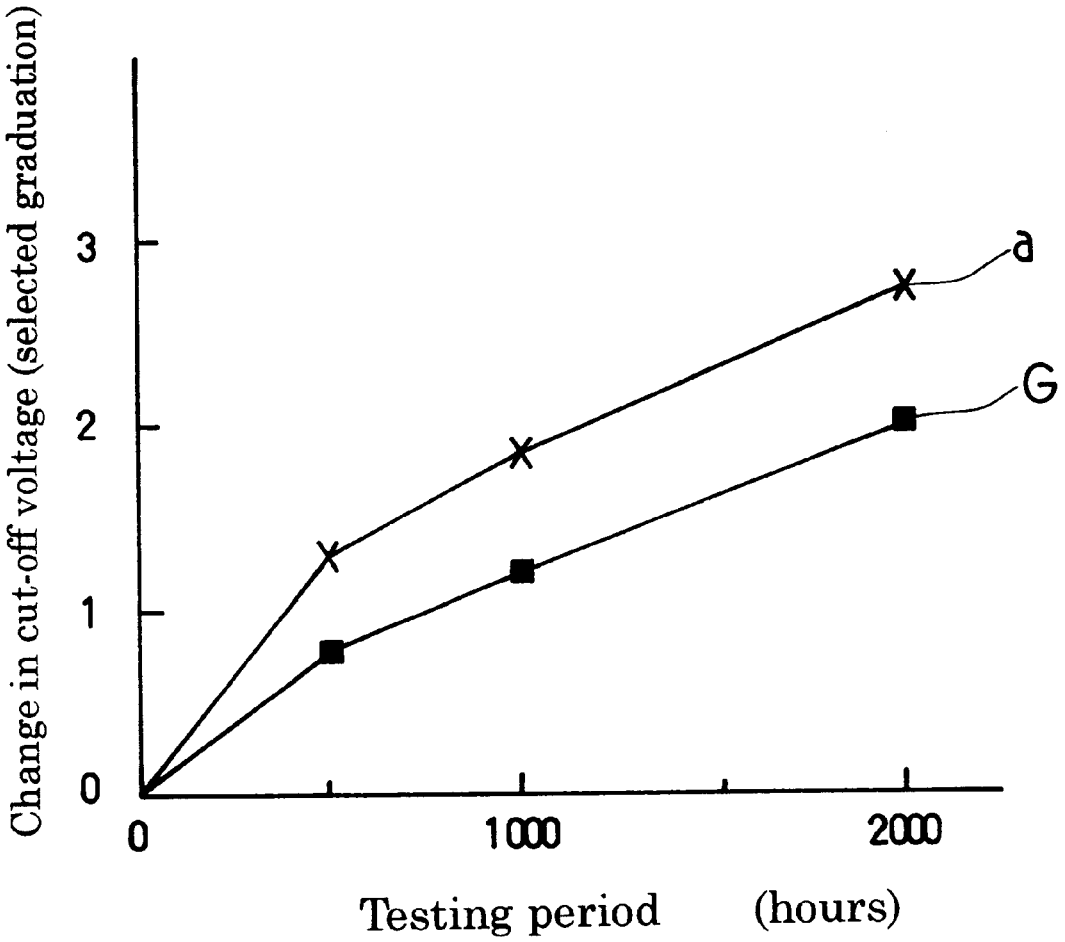
FIG. 9 is a graph showing the change in cut-off voltage with time in an embodiment of a cathode of the present invention.

FIG. 9 shows the change in cut-off voltage with time in the accelerated life test. In the figure, line G indicates the result in the case of the cathode of this example in which niobium oxide was added to the emissive material layer; and line (a) indicates the result of a conventional cathode without niobium oxide. As clearly shown in FIG. 9, the change in cut-off voltage by the accelerated life test becomes small when niobium oxide is added to the emissive material layer. In this example, niobium oxide was added to the emissive material layer, but the same results are obtained when niobium is used instead. Like vanadium, niobium and niobium oxide easily can be obtained in the industry and are also economical. Thus, by adding niobium or niobium oxide to the emissive material layer, an economical cathode is provided.

Similar to the contents of vanadium and vanadium oxide mentioned in Example 3, the contents of niobium and niobium oxide relative to the emissive material layer are 0.001 wt. % to 5 wt. % and 0.002 wt. % to 6 wt. % respectively, so that the effect of reducing the deterioration of emission current is obtained.

Example 5

In the processes for manufacturing the cathode of Example 3, a mixed material was prepared by adding tantalum oxide, instead of vanadium oxide, at 1 wt. % relative to barium/strontium carbonate (1.3 wt. % relative to an emissive material layer). The mixed material was adhered onto a cathode substrate in a thickness of about 50 $\mu$m, and was then thermally decomposed at 930° C. in a vacuum. As a result, a cathode was provided that had an emissive material layer including barium/strontium oxide and tantalum oxide.

The cathode prepared as described above was used in a CRT for displays, and an accelerated life test was carried out for 2,000 hours while the current density was set at 2.7A/cm$^2$ at the beginning of the operation.

Figure 10:
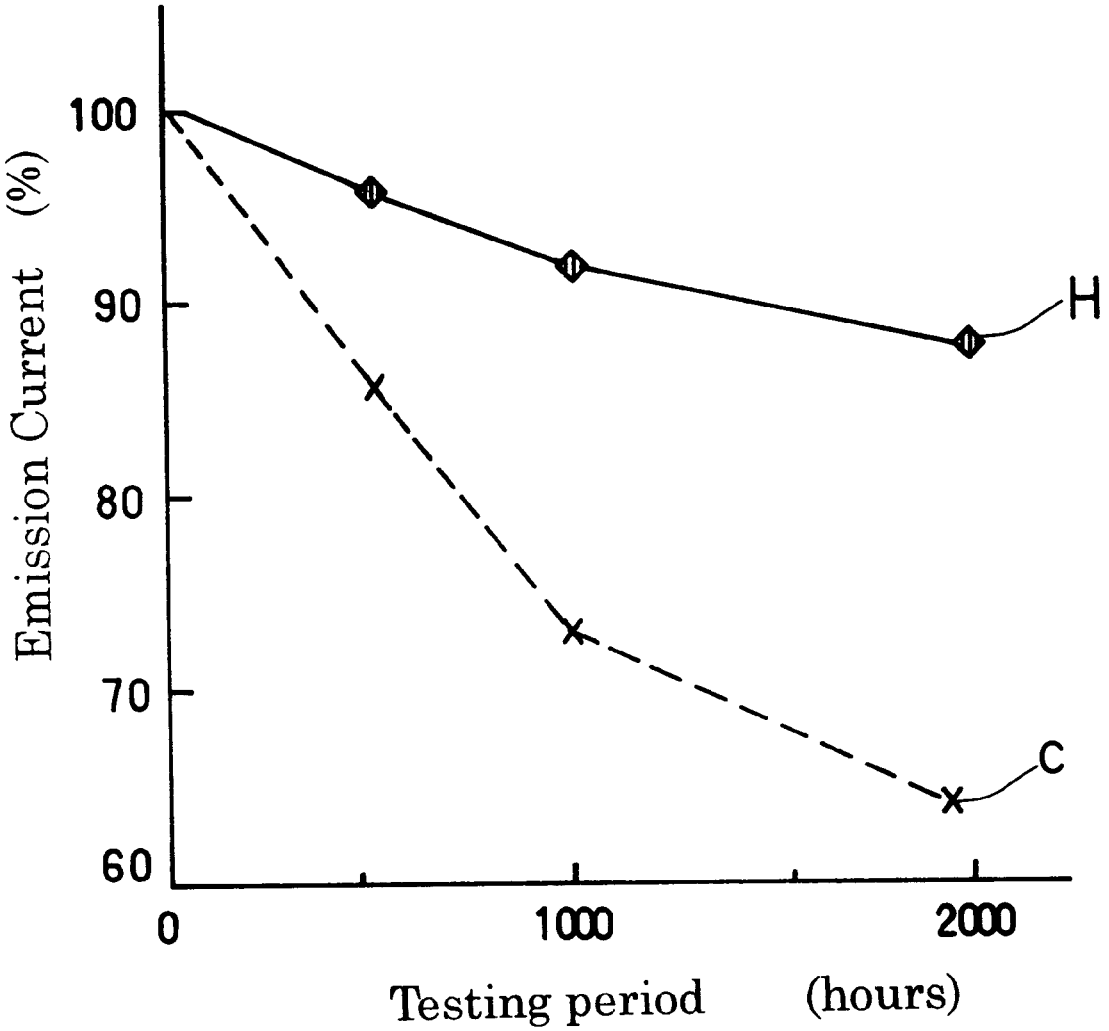
FIG. 10 is a graph showing the change in emission current with time in an embodiment of a cathode of the present invention.

FIG. 10 shows the change in emission current with time in the accelerated life test. In the figure, line H indicates the result of the cathode of this example in which tantalum oxide was added to the emissive material layer; and line (c) shows the result of a conventional cathode. As clearly shown in FIG. 10, the cathode has a much smaller decrease in emission voltage in the accelerated life test than the conventional cathode when tantalum oxide was added to the emissive material layer, so that the life of the cathode improves. In this example, tantalum oxide was added to the emissive material layer, but the same results are obtained when tantalum is used instead.

Tantalum and tantalum oxide easily can be obtained in the industry and are also economical. Thus, by adding tantalum or tantalum oxide to the emissive material layer, an economical cathode is provided. Similar to the contents of vanadium and vanadium oxide mentioned in Example 3, the contents of tantalum and tantalum oxide relative to the emissive material layer are 0.001 wt. % to 5 wt. % and 0.002 wt. % to 6 wt. % respectively, so that the effect of limiting the decrease in emission current is obtained.

Figure 11:
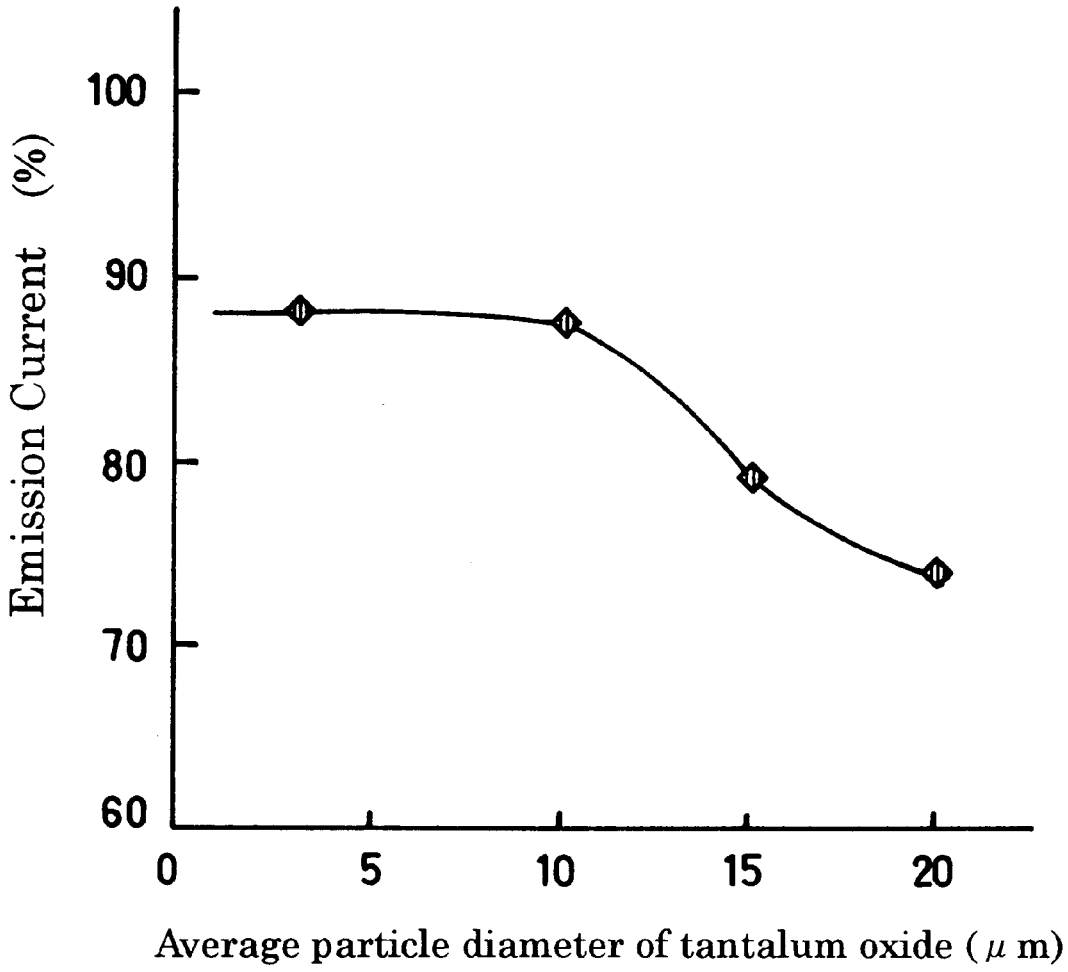
FIG. 11 is a graph showing the relationship between the particle diameters of tantalum oxide and the change in emission current in an embodiment of a cathode of the present invention.

When vanadium oxide, niobium oxide or tantalum oxide are added to the emissive material layer in particle form, the decrease in emission current is found to be different depending on particle diameter. FIG. 11 shows the relationship between the average particle diameter of tantalum oxide and emission current (%) after 2,000 hours of testing, wherein the emission current is 100% at the beginning of the accelerated life test. According to the figure, the decrease in emission current was prevented effectively when the average particle diameter of tantalum oxide was 10 $\mu$m or less.

The same results were obtained when the particles of vanadium oxide or niobium oxide were added to the emissive material layer. Therefore, in adding vanadium oxide, niobium oxide or tantalum oxide into an emissive material layer in particle form, the average particle diameter is preferably 10 $\mu$m or less.

Example 6

To a nitrate solution of barium and strontium (1:1 mole ratio) containing vanadium nitrate at 0.01 mole % relative to the total amount of the nitrate in the solution, a solution of sodium carbonate was added, thus preparing the ternary coprecipitated carbonate of barium/strontium/vanadium containing vanadium at 0.01 mole %. The carbonate was adhered onto a cathode substrate in a thickness of about 50 $\mu$m, and was thermally decomposed in a vacuum at 930° C. Thus, a cathode was provided that had an emissive material layer, made of barium/strontium/vanadium oxide containing vanadium at 0.004 wt. %.

Figure 12:
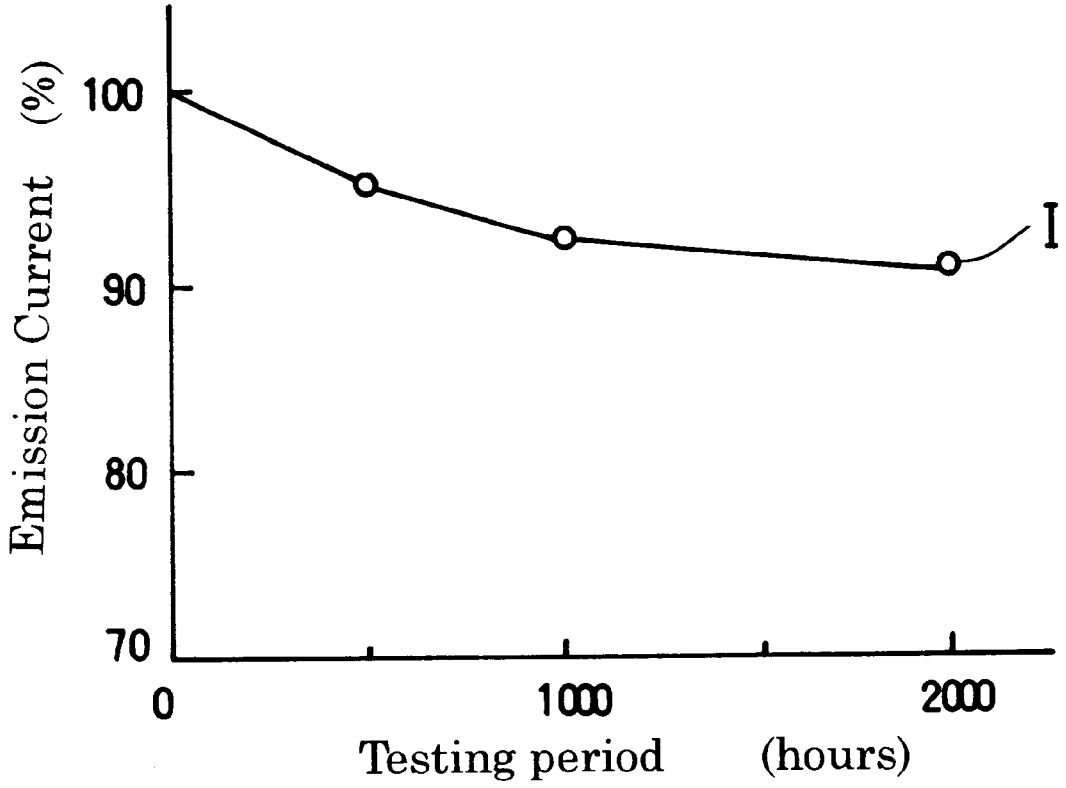
FIG. 12 is a graph showing the change in emission current with time in an embodiment of a cathode of the present invention.

The cathode prepared as described above was used in a CRT for displays, and an accelerated life test was carried out for 2,000 hours while the current density of the CRT was set at 2.0A/cm$^2$ at the beginning of the operation. FIG. 12 shows the change in emission current with time in the accelerated life test. In the figure, line I indicates the result in the case of the cathode having the emissive material layer in which vanadium was coprecipitated.

As clearly shown in FIG. 12, the decrease in emission current in the accelerated life test becomes small when vanadium is coprecipitated in the emissive material layer, so that the life of the cathode improves. The same results were also obtained when niobium nitrate was used instead of vanadium nitrate to form an emissive material layer of a barium/strontium/niobium coprecipitated oxide. The effect of reducing the deterioration of emission current was obtained effectively in this example when vanadium and niobium were contained in a range of 0.001 wt. % to 1 wt. % relative to the emissive material layer.

Example 7

Into a nitrate solution of barium and strontium (1:1 mole ratio), tantalum was dissolved at 0.01 mole % relative to the whole nitrate solution. Then, a solution of sodium carbonate was added, thus preparing a coprecipitated material of tantalum and barium/strontium carbonate containing tantalum at 0.01 mole %.

The coprecipitated material was adhered onto a cathode substrate at a thickness of about 50 $\mu$m, and was thermally decomposed in a vacuum at 930° C. Thus, a cathode was provided that had an emissive material layer made of barium/strontium oxide containing tantalum at 0.014 wt. %.

The cathode prepared as described above was used in a CRT for displays, and an accelerated life test was carried out for 2,000 hours while the current density of the CRT was set at 2.7A/cm$^2$ at the beginning of the operation.

Figure 13:
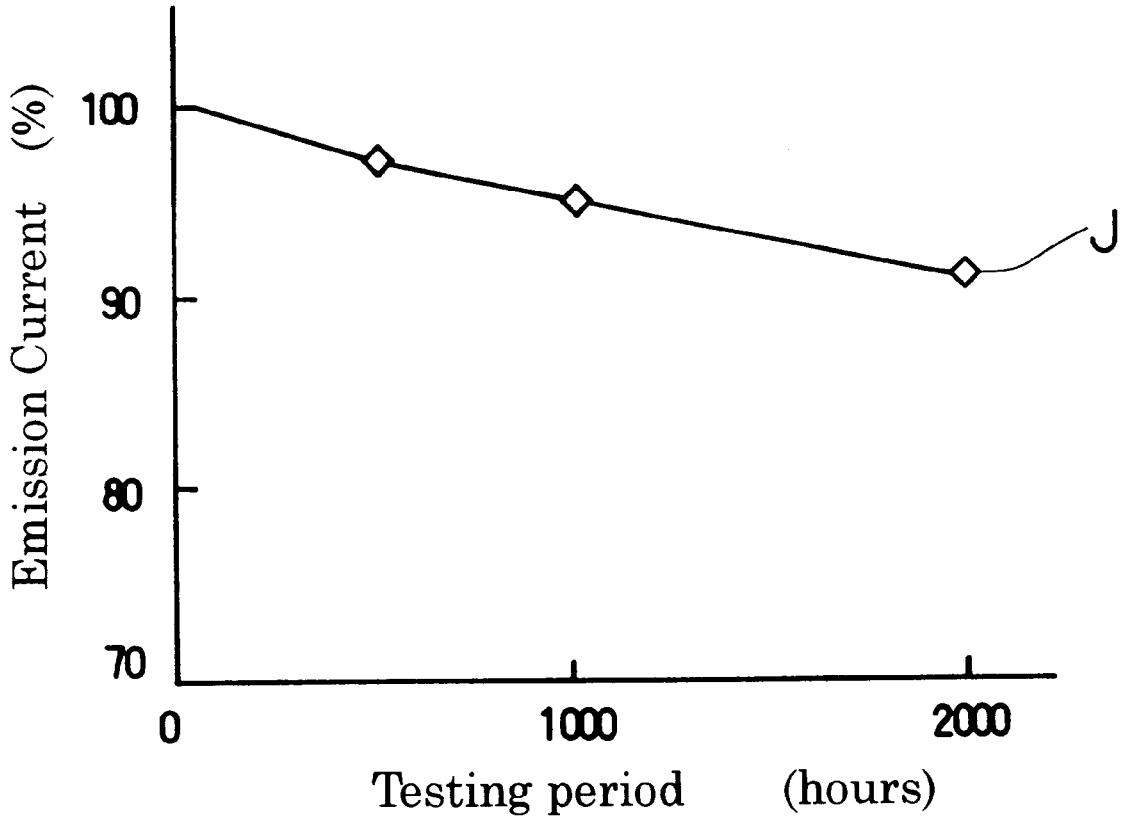
FIG. 13 is a graph showing the change in emission current with time in an embodiment of a cathode of the present invention.

FIG. 13 shows the change in the emission current with time in the accelerated life test. In the figure, line J indicates the test result of the cathode having the emissive material layer in which tantalum was coprecipitated. As clearly shown in FIG. 13, the decrease in emission current by the accelerated life test becomes small when tantalum is coprecipitated in the emissive material layer, so that the life of the cathode increases. The effect of reducing the deterioration of the emission current was obtained effectively in this example when the content of tantalum was from 0.001 wt. % to 1 wt. % relative to the emissive material layer.

The invention may be embodied in other forms without departing from the spirit or essential characteristics thereof. The embodiments disclosed in this application are to be considered in all respects as illustrative and not restrictive, the scope of the invention is indicated by the appended claims rather than by the foregoing description, and all changes which come within the meaning and range of equivalency of the claims are intended to be embraced therein.

What is claimed is:

1. A cathode for an electron tube having an emissive material adhered onto a metal substrate comprising nickel as a main component, the emissive material comprising a plurality of particles, wherein each particle in the plurality of particles includes an alkaline earth metal oxide as a main component and at least one element selected from the group consisting of titanium, zirconium and hafnium.

2. The cathode according to claim 1, wherein the emissive material comprises the element at 0.001 wt. % to 1 wt. % relative to the total weight of the emissive material.

3. The cathode according to claim 2, wherein the emissive material comprises the element at 0.001 wt. % to 0.1 wt. % relative to the total weight of the emissive material.

4. The cathode according to claim 1, wherein the emissive material further comprises particles consisting of an alkaline earth metal oxide.

5. The cathode according to claim 4, wherein the particles that include the alkaline earth metal oxide as a main component and the element are present in an amount of 20 wt. % to 80 wt. % relative to the total weight of the emissive material.

6. The cathode according to claim 1, wherein the particles are obtained by thermally decomposing carbonate including the alkaline earth metal and the element.

7. A cathode for an electron tube having an emissive material adhered onto a metal substrate comprising nickel as a main component, the emissive material comprising a plurality of particles, wherein each particle in the plurality of particles includes an alkaline earth metal oxide as a main component and at least one element selected from the group consisting of vanadium, niobium and tantalum.

8. The cathode according to claim 7, wherein the emissive material comprises the element as an oxide.

9. The cathode according to claim 8, wherein the emissive material comprises the oxide at 0.002 wt. % to 6 wt. % relative to the total weight of the emissive material.

10. The cathode according to claim 8, wherein the emissive material comprises the oxide as particles having an average particle diameter of 10 $\mu$m or less.

11. The cathode according to claim 7, wherein the particles are obtained by thermally decomposing carbonate including the alkaline earth metal and the element.

12. A cathode for an electron tube having an emissive material adhered onto a metal substrate comprising nickel as a main component, the emissive material comprising an alkaline earth metal oxide as a main component and at least one element selected from the group consisting of vanadium, niobium and tantalum, wherein the emissive material comprises the element as a metal.

13. The cathode according to claim 12, wherein the emissive material comprises the metal at 0.001 wt. % to 5 wt. % relative to the total weight of the emissive material.

14. A method for manufacturing a cathode for an electron tube, comprising the step of thermally decomposing carbonate comprising an alkaline earth metal and at least one element selected from the group consisting of titanium, zirconium, hafnium, vanadium, niobium and tantalum, so as to adhere an emissive material comprising a plurality of particles onto a metal substrate comprising nickel as a main component, wherein each particle of the plurality of particles includes an oxide of the alkaline earth metal as a main component and the element.

15. The method according to claim 14, wherein the carbonate is thermally decomposed in a vacuum.

16. The method according to claim 14, further comprising the step of coprecipitating, from a solution comprising a nitrate of at least one element selected from the group consisting of vanadium, niobium, titanium and zirconium, and a nitrate of an alkaline earth metal, the element and the alkaline earth metal as carbonate.

17. The method according to claim 16, wherein the element and the alkaline earth metal are coprecipitated as carbonate by mixing the nitrate solution with a solution comprising a carbonate ion.

18. The method according to claim 17, wherein the solution comprising a carbonate ion is a solution comprising at least one salt selected from the group consisting of carbonate of an alkaline metal, hydrogencarbonate of an alkaline metal, ammonium carbonate and ammonium hydrogencarbonate.

19. The method according to claim 14, further comprising the step of mixing a solution comprising a carbonate of an alkaline earth metal and tantalum with a solution comprising a nitrate of an alkaline earth metal so as to coprecipitate the tantalum and the alkaline earth metal as carbonate.

* * * * *